US008820287B2

(12) United States Patent
Solberg et al.

(10) Patent No.: US 8,820,287 B2
(45) Date of Patent: Sep. 2, 2014

(54) SUPPLEMENTARY ENERGY STARTING SYSTEM INCORPORATING A TIMING CIRCUIT

(75) Inventors: Dean Solberg, Burlington, WI (US); James Burke, Richmond, IL (US)

(73) Assignee: Kold-Ban International, Ltd., Lake In The Hills, IL (US)

( * ) Notice: Subject to any disclaimer, the term of this patent is extended or adjusted under 35 U.S.C. 154(b) by 375 days.

(21) Appl. No.: 13/400,254

(22) Filed: Feb. 20, 2012

(65) Prior Publication Data

US 2013/0213336 A1 Aug. 22, 2013

(51) Int. Cl.
*F02N 11/08* (2006.01)

(52) U.S. Cl.
USPC ..... 123/179.3

(58) Field of Classification Search
USPC ..... 123/179.3, 179.28; 290/38 R; 307/10.6
See application file for complete search history.

(56) References Cited

U.S. PATENT DOCUMENTS 5,157,267 A 10/1992 Shirata et al.
5,260,637 A 11/1993 Pizzi
5,321,389 A 6/1994 Meister
5,642,696 A 7/1997 Matsui
6,242,887 B1 6/2001 Burke
6,362,595 B1 3/2002 Burke
6,819,010 B2 11/2004 Burke
6,871,625 B1 3/2005 Burke
6,888,266 B2 5/2005 Burke et al.
6,988,475 B2 1/2006 Burke
6,988,476 B2 1/2006 Solberg
7,134,415 B2 11/2006 Burke et al.
7,198,016 B2 4/2007 Burke
2009/0056661 A1 3/2009 Cook et al.

*Primary Examiner* — Hai Huynh
(74) *Attorney, Agent, or Firm* — Brinks Gilson & Lione

(57) ABSTRACT

An engine cranking system and a method of cranking an engine are provided. The engine cranking system comprises an engine, cranking motor, and capacitor. The engine cranking system further comprises an electrical path interconnecting the cranking motor or a battery to the capacitor. The engine cranking system further comprises a control circuit coupled to the capacitor. The control circuit comprises a timer operative to track temporal information. The control circuit is operative to apply a control voltage that varies in response to the tracked temporal information. The control circuit further comprises a relay included in the electrical path. The relay is operative to switch, in response to the control voltage, between an open-circuit condition, in which the relay interrupts the electrical path, and a closed-circuit condition.

25 Claims, 6 Drawing Sheets

SUPPLEMENTARY ENERGY STARTING SYSTEM INCORPORATING A TIMING CIRCUIT

BACKGROUND

1. Field of the Invention

The present disclosure generally relates to vehicles having an internal combustion engine, a cranking motor, and a battery normally used to power the cranking motor. More specifically, the present disclosure relates to improvements to such systems that increase the reliability of engine starting.

2. Description of the Related Art

A problem presently exists with vehicles such as heavy-duty trucks. Drivers may on occasion run auxiliary loads excessively when the truck engine is not running. It is not unusual for heavy-duty trucks to include televisions and other appliances, and these appliances are often used when the truck is parked with the engine off. Excessive use of such appliances can drain the vehicle batteries to the extent that it is no longer possible to start the truck engine.

Various systems have been developed that use a capacitor to supplement the vehicle batteries such that the vehicle can be started. Often, however, the capacitor is not completely isolated, and can lose its charge over time, for example by leaking through one or more diodes. In other systems, wherein the capacitor is completely isolated when not in use, the capacitor is also isolated from the one or more switches or relays used to connect the capacitor to the cranking motor, such that the capacitor cannot be used to close the switch or relay to bring the capacitor on line.

Also, the operation of many existing systems is dependent on vehicle programming, and so such systems cannot be implemented as self-contained units connectable with the vehicle electrical system. For example, existing systems commonly use an oil-pressure sensor to detect when an engine is running, during which time the capacitor is connected to the system.

Additionally, capacitors in some existing systems cannot be used for cranking when the battery is completely discharged by auxiliary loads when the engine is not running.

SUMMARY

In overcoming the drawbacks and other limitations of the related art, the present disclosure provides an improved engine cranking system and an improved method of cranking an engine. For example, neither vehicle programming nor an oil pressure sensor is required. The improved engine cranking system can be connected to the vehicle system as a self-contained unit. Additionally, the capacitor can be used to crank the engine even if either the battery is completely discharged or there is no battery. Also, the capacitor is completely isolated when not charging or not in use for cranking.

In some embodiments, the present disclosure relates to an engine cranking system. The engine cranking system comprises an engine operably moveable between a running condition and an off condition. The engine cranking system further comprises a cranking motor coupled to the engine. The engine cranking system further comprises a capacitor with first and second capacitor terminals. The engine cranking system further comprises a first electrical path interconnecting at least one of the cranking motor or at least one battery to one of the first or second capacitor terminals. The engine cranking system further comprises a control circuit coupled to the capacitor. The control circuit comprises a timer operative to track temporal information. The control circuit is operative to apply a control voltage that varies in response to the tracked temporal information. The control circuit further comprises a first relay included in the first electrical path. The first relay is operative to switch, in response to the control voltage, between a first open-circuit condition, in which the relay interrupts the first electrical path, and a first closed-circuit condition.

In some embodiments, the present disclosure relates to a method of cranking an engine. The method comprises providing the engine cranking system. The method further comprises tracking temporal information. The method further comprises applying a control voltage that varies in response to the tracking of the temporal information. The method further comprises switching the first relay, in response to the control voltage being applied thereto, from a first open-circuit condition, in which the relay interrupts the first electrical path, to a first closed-circuit condition, thereby completing the first electrical path.

In some embodiments, the present disclosure relates to an engine cranking system. The engine cranking system comprises an engine operably moveable between a running condition and an off condition. The engine cranking system further comprises a cranking motor coupled to the engine. The engine cranking system further comprises a capacitor with first and second capacitor terminals. The engine cranking system further comprises a first electrical path interconnecting at least one of the cranking motor or at least one battery to one of the first and second capacitor terminals. The engine cranking system further comprises a control circuit coupled to the capacitor. The control circuit comprises a timer relay including a timer that is operative to count down a predetermined period of time. The timer relay is operative to switch, in response to whether the predetermined period of time has elapsed, between a first open-circuit condition, in which the timer relay interrupts a second electrical path, and a first closed-circuit condition. The control circuit is operative to apply a control voltage, at least in part from the capacitor, that varies in response to the whether the predetermined period of time has elapsed. The control circuit further comprises a relay included in the first electrical path. The relay is operative to switch, in response to the control voltage, between a second open-circuit condition, in which the relay interrupts the first electrical path, and a second closed-circuit condition.

Further features and advantages of the present disclosure will become apparent from consideration of the following description and the appended claims when taken in connection with the accompanying drawings. It should be understood that the description and specific examples are intended for purposes of illustration only and are not intended to limit the scope of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
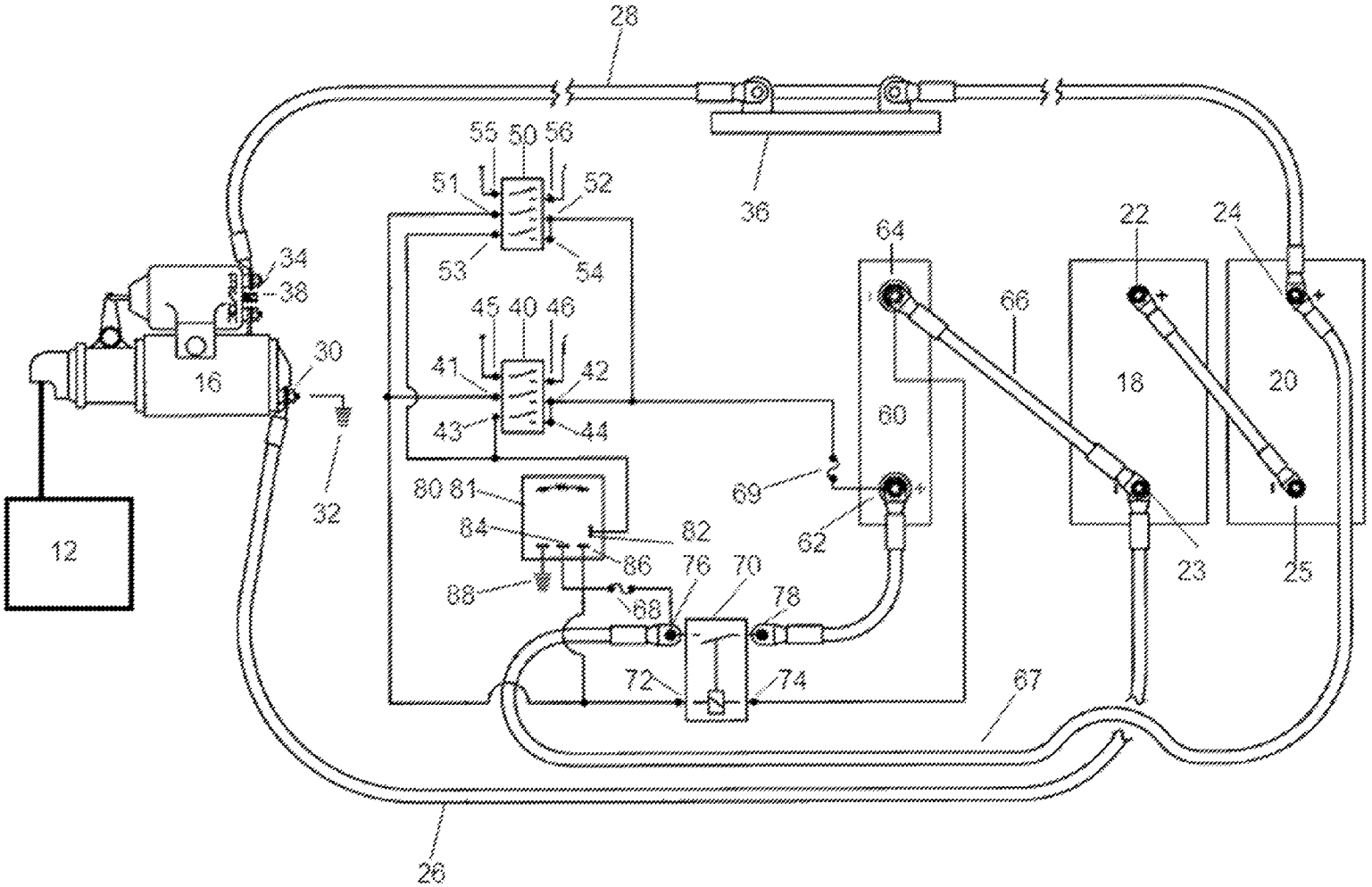
FIG. 1 is a schematic diagram of a vehicle electrical system in accordance with the principles of the present disclosure, with an ignition switch in an off position, a relay in an open-circuit condition, and a timer relay in an open-circuit condition.
Figure 2:
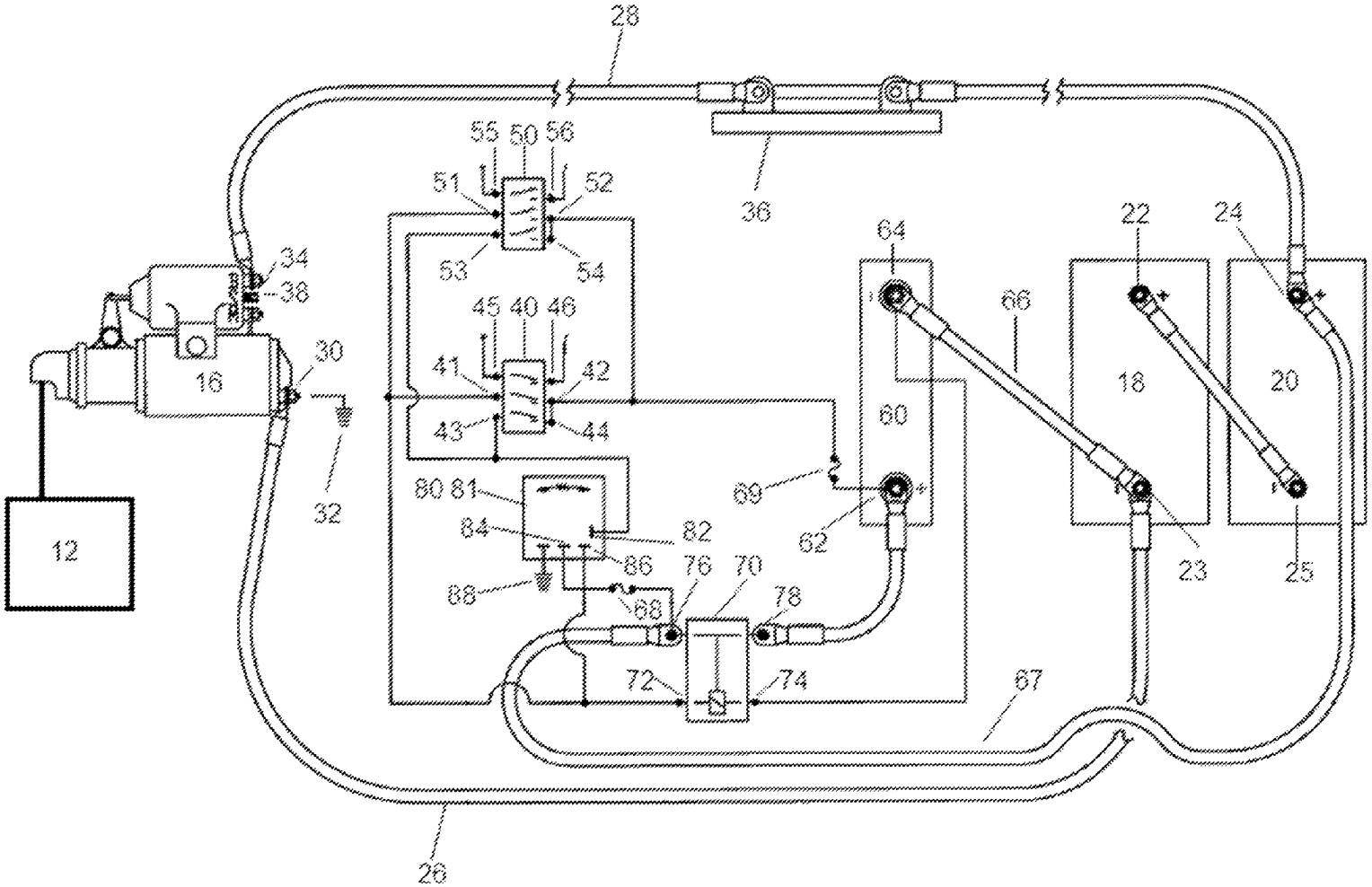
FIG. 2 is a schematic diagram of the vehicle electrical system of FIG. 1 in accordance with the principles of the present disclosure, with the ignition switch in a start position, the relay in a closed-circuit condition, and the timer relay in a closed-circuit condition.
Figure 3:
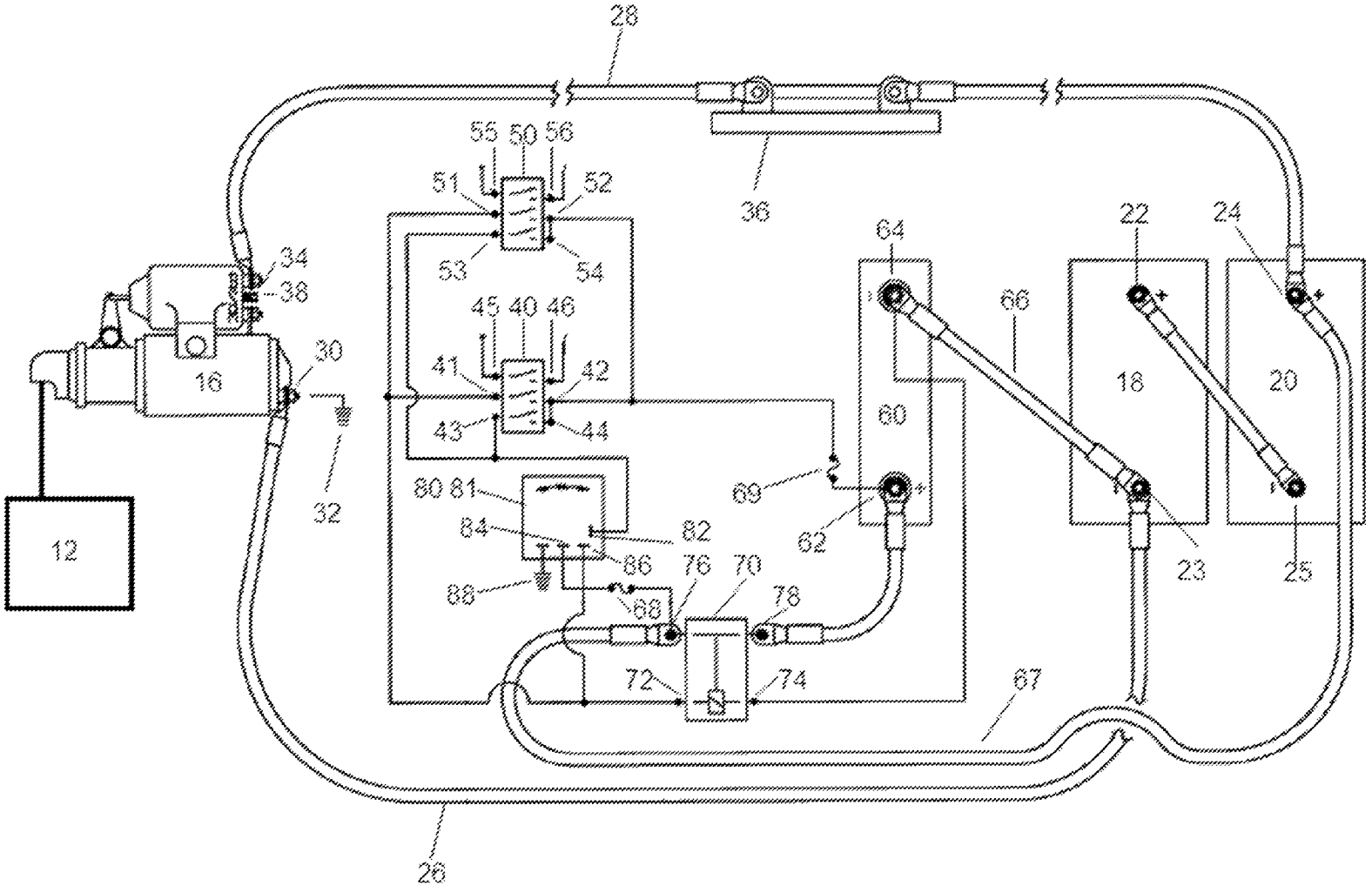
FIG. 3 is a schematic diagram of the vehicle electrical system of FIG. 1 in accordance with the principles of the present disclosure, with the ignition switch in the on/run position, the relay in a closed-circuit condition, and the timer relay in the closed-circuit condition.

FIGS. 1-3 show various embodiments of an electrical system of a vehicle (not shown) that includes an internal combustion engine 12. The engine 12 can take any suitable form, and may for example be a conventional diesel or gasoline engine. The engine 12 is mechanically coupled to a cranking motor 16. The cranking motor 16 can take any suitable form, and it is conventionally an electrical motor that is powered during cranking conditions by current from storage batteries 18, 20 such as conventional lead-acid batteries. In other embodiments, one storage battery or more than two storage batteries may be used, or there may be no batteries. The batteries 18, 20, which can be provided in an enclosure (not shown), can be coupled or removably coupled to other components in the electrical system. Battery 18 has positive terminal 22 and negative terminal 23, and battery 20 has positive terminal 24 and negative terminal 25. Positive terminal 22 is electrically coupled to negative terminal 25. The negative terminal 23 is electrically coupled to the cranking motor 16 at terminal 30 via an electrical path 26 that includes a suitable cable. The terminal 30 is electrically coupled to a system ground 32. The positive terminal 24 is electrically coupled to a B terminal 34 of the cranking motor 16 via an electrical path 28 that includes a suitable cable and a master disconnect switch 36 which is operable between a closed position (shown in FIGS. 1-3) which closes the electrical path 28 and an open position (not shown) which opens the electrical path 28. Current from the batteries 18, 20 is switched to the cranking motor 16 via a switch such as a conventional solenoid switch 38. All of the elements 12 through 38 described above may be arranged in various embodiments without falling beyond scope of the present disclosure.

The solenoid switch 38 is activated for example when an ignition switch 40, located in the front of the vehicle, is moved to a start position. The ignition switch 40 can be a triple pole, single throw (TPST) start switch comprised of a first switch having switched terminals 41, 42, a second switch having switched terminals 43, 44, and a third switch having switched terminals 45, 46. In operation, the engine is operably moved between a running condition and an off condition. A conventional ignition switch includes four positions: accessory, off, on/run, and start. The terminals 45, 46 are used to interface with the vehicle's existing starting circuit (not shown) for ignition if the ignition switch 40 cannot provide the needed set of separate and independent contacts. Of course, in other embodiments, other switches having other positions can be used. In addition, in some embodiments, a switch can be positioned between at least an off and run position, and a separate push-button, crank switch is actuated to crank the motor. In such an embodiment, one or both of the off/run switch and the separate push-button switch are defined as an ignition switch, with the combined ignition switches being in the "start" position when the on/off switch is in the "on" position and the crank switch is in the engaged position. The electrical system also has a rear ignition switch 50 which is identical to the ignition switch 40 except that it is located in the rear rather than the front of the vehicle. The rear ignition switch 50 is comprised of a first switch having switched terminals 51, 52, a second switch having switched terminals 53, 54, and a third switch having switched terminals 55, 56. The switched terminals 42, 52 are respectively electrically coupled to the switched terminals 44, 54 via electrical paths that include suitable cables.

In addition to the conventional electrical system described above, the vehicle also includes a supplemental electrical system including a capacitor 60 and a control circuit. The supplemental electrical system, which can be housed in an enclosure (not shown), can be coupled or removably coupled to the conventional electrical system. The capacitor 60 is preferably a double layer capacitor of the type known in the art as an electrochemical capacitor. For example, a capacitor can be used such as that supplied by KBI, under trade name KAPower, as part number 571004. In some embodiments, the capacitor 60 has a capacitance of 500 farads, a stored energy capacity of 120 kilojoules, an internal resistance at 25 degrees Celsius of 0.006 ohms, and a maximum storage capacity of 35 kilowatts. In general, the capacitor should have a capacitance greater than 149 farads, and an internal resistance at 25 degrees Celsius that is preferably less than 0.008 ohms, more preferably less than 0.006 ohms, and most preferably less than 0.003 ohms. The energy storage capacity is preferably greater than 15 kJ. Such capacitors provide the advantage that they deliver high currents at low temperatures and relatively low voltages because of their unusually low internal resistance. Further information about suitable capacitors for use in the system of FIGS. 1-3 can be found in publications of ELTON, Troitsk, Moscow region, Russia and on the Internet at www.elton-cap.com. Moreover, the capacitor 60 could be of any other type suitable for the present disclosure. Though not shown in the Figures, the electrical system of the vehicle includes a conventional generator or alternator driven by the engine when running to charge both the batteries 18, 20 and capacitor 60. In embodiments lacking the batteries 18, 20, the generator or alternator, or another feature of the electrical system, charges the capacitor 60, but does not charge any batteries.

The capacitor 60 includes a positive terminal 62 and a negative terminal 64. The negative terminal 64 is electrically coupled to the negative terminal 23 of battery 18 via electrical path 66. The positive terminal 62 is electrically coupled to the positive terminal 24 of battery 20 via the electrical path 67 that includes a suitable cable and a relay 70 that is included in the control circuit. In embodiments lacking the batteries 18, 20, the terminals 22, 23, 24, 25 are also absent, and thus the electrical paths 26 and 66 may be form a single direct electrical path, and the electrical path 28 and electrical path 67 may form a single direct electrical path.

The relay 70 includes first and second control terminals 72, 74 and first and second switched terminals 76, 78. The first control terminal 72 is electrically coupled to each of the switched terminals 41, 51 of the ignition switches 40, 50 via intersecting electrical paths that include suitable cables. The second control terminal 74 is electrically coupled to the negative terminal 64 of the capacitor 60 via an electrical path. The switched terminals 76, 78 are included in the electrical path 67 such that the relay 70 interrupts the electrical path 67 when the relay is in an open-circuit condition. The relay 70 completes the electrical path 67 when the relay is in a closed-circuit condition. The relay 70 may take many forms, and may be a contactor relay. For example, a 24 volt contactor relay can be used such as that supplied by Tyco Electronics as part number LEV200A5ANF The switched terminals 42, 52 of the ignition switches 40, 50 are each electrically coupled to the positive terminal 62 of the capacitor 60 via intersecting electrical paths that include suitable cables and a five amp fuse 69.

The control circuit includes a timer relay 80 having start, power, and load switched terminals 82, 84, 86 and a system ground 88. The timer relay 80 has a timer 81. One suitable timer relay is available from Inpower, LLC as part number VCM-04-10MA. The start switched terminal 82 (or control terminal) of the timer relay 80 is electrically coupled to the switched terminals 43, 53 of the respective ignition switches 40, 50 via electrical paths. The power switched terminal 84 of the timer relay 80 is electrically coupled to the first switched terminal 76 of the relay 70 via an electrical path that includes a five amp fuse 68. The load switched terminal 86 of the timer relay 80 is electrically coupled to the first control terminal 72 of the relay 70 via an electrical path. The timer relay 80 is operable to switch between an open-circuit condition, startup condition, and timer condition, as will be described below in more detail.

The operation of the electrical systems is shown sequentially in FIGS. 1-3. FIG. 1 shows the ignition switches 40, 50 each in their respective off positions, and the relay 70 and the timer relay 80 each in their respective open-circuit conditions. The batteries 18, 20 may contain energy or may be in a charged or discharged state.

FIG. 2 shows the ignition switch 40 switched into the start position which causes the capacitor 60 to apply to a voltage between the control terminals 72, 74, thus closing the relay 70 and completing the electrical path 67. Thus the capacitor 60 and the batteries 18, 20 are connected along parallel paths to the cranking motor 16. The batteries 18, 20, if they are installed and have any charge, and the capacitor 60 power the cranking motor 16 during ignition. However if the batteries 18, 20 are discharged or absent, the capacitor 60 is operable on its own to power the cranking motor 16 during ignition. Thus, even in embodiments lacking batteries altogether, the capacitor 60 can still power the cranking motor 16. The capacitor 60 also applies a voltage between the start switched terminal 82 and the power and/or load switched terminals 84, 86, thus activating the timer relay 80 from the open-circuit condition to the startup condition. In other embodiments (not shown), a secondary capacitor, battery, or other power source, rather than the capacitor 60, can provide the voltage between the start switched terminal 82 and the power and/or load switched terminals 84, 86. The ignition switch 50 can be used instead of ignition switch 40 to initiate the same process described above.

FIG. 3 shows the ignition switch 40 switched into the on/run position, which opens the electrical paths between switched terminals 41 and 42 and between switched terminals 43 and 44. Thus the capacitor 60 no longer applies a voltage between the start switched terminal 82 and the power and/or load switched terminals 84, 86, causing the timer relay 80 to exit the startup condition and enter the timer condition. In the timer condition, the timer 81 tracks temporal information, and the control voltage applied between the control terminals 72 and 74 varies in response to the tracked temporal information. More specifically, a timer 81 begins counting down a predetermined period of time. In the timer condition, a closed electrical path is formed between the power and load switched terminals 84, 86, causing the capacitor 60 to continue to apply a voltage between the control terminals 72 and 74 thus keeping the relay 70 closed and the electrical path 67 closed. Thus a part of the vehicle electrical system, for example the generator or alternator, charges the capacitor 60 during the predetermined period of time in the timer condition. The predetermined period of time is selected to have a value sufficient for the capacitor 60 to be fully charged. For example, the predetermined period of time may have a value between about 30 seconds and about 10 minutes, and preferably takes a value between about 2 and about 3 minutes, for example about 2, 2.5, or 3 minutes. Additionally, the generator or alternator charges the batteries 18, 20, if any.

Once the predetermined period of time on the timer 81 has elapsed, the electrical path between the second and third switched terminals 84, 86 opens, and the timer relay 80 switches from the timer condition to the open-circuit condition. The electrical circuit thus returns to the condition shown in FIG. 1. At this point the capacitor 60 is fully charged, and electrically isolated such that it is prevented from discharging and so that its charge will be available for the next cranking event. The vehicle continues to run, based on power provided from the batteries 18, 20 or from the vehicle electrical system which includes the generator and alternator, until the ignition switch 40 is switched from the on/run position to the off position. The driver of the vehicle is free to use accessory power as desired, but such usage will at most drain the batteries 18, 20, if used, while leaving the capacitor 60 in a full state of charge.

Figure 4:
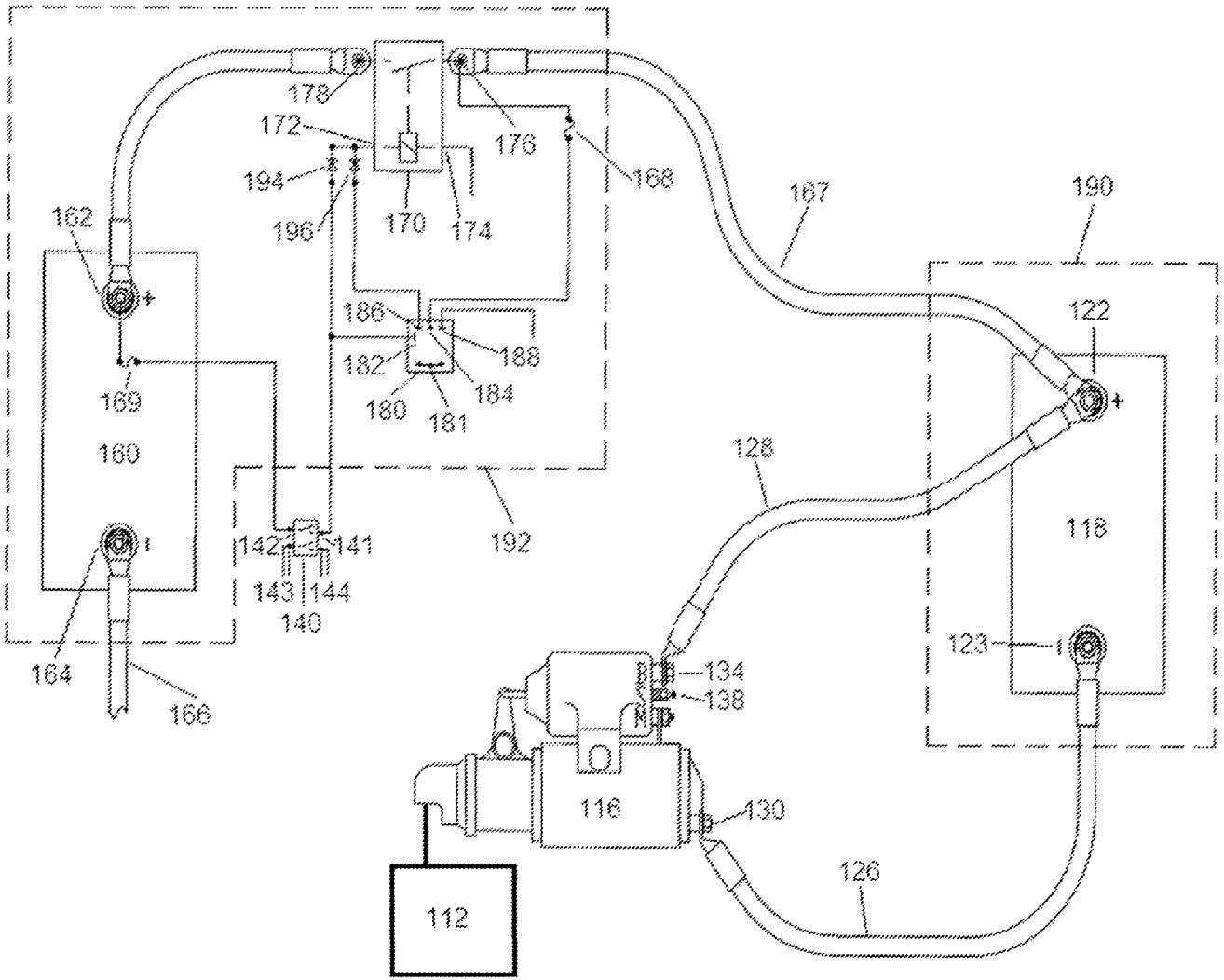
FIG. 4 is a schematic diagram of a vehicle electrical system in accordance with the principles of the present disclosure, with an ignition switch in an off position, a relay in an open-circuit condition, and a timer relay in an open-circuit condition.
Figure 5:
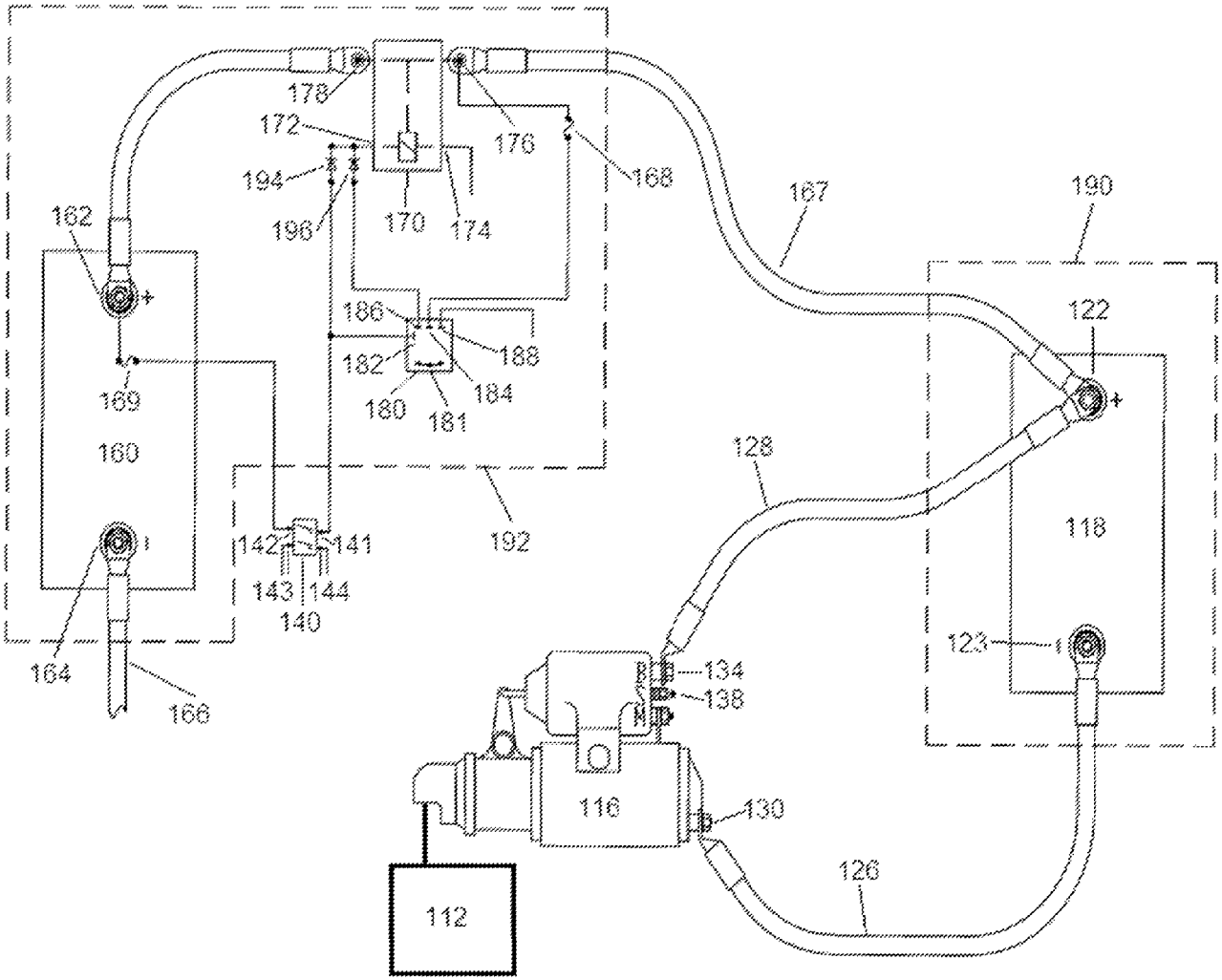
FIG. 5 is a schematic diagram of the vehicle electrical system of FIG. 4 in accordance with the principles of the present disclosure, with the ignition switch in a start position, the relay in a closed-circuit condition, and the timer relay in a closed-circuit condition.
Figure 6:
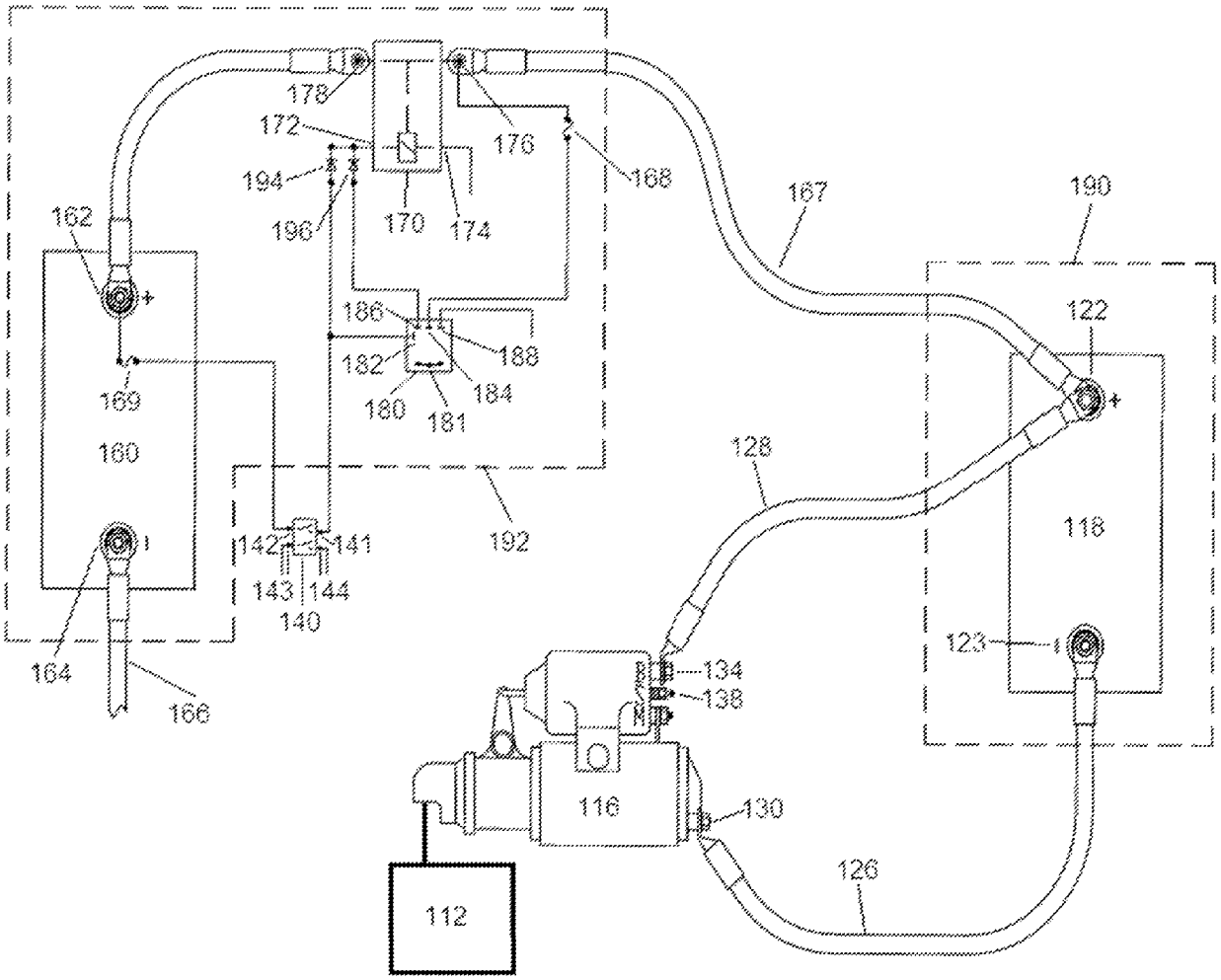
FIG. 6 is a schematic diagram of the vehicle electrical system of FIG. 4 in accordance with the principles of the present disclosure, with the ignition switch in the on/run position, the relay in a closed-circuit condition, and the timer relay in the closed-circuit condition.

FIGS. 4-6 show various embodiments of an electrical system of a vehicle (not shown) that includes an internal combustion engine 112. The engine 112 can take any suitable form, and may for example be a conventional diesel or gasoline engine. The engine 112 is mechanically coupled to a cranking motor 116. The cranking motor 116 can take any suitable form, and it is conventionally an electrical motor that is powered during cranking conditions by current from storage batteries 118 such as conventional lead-acid batteries. Any number of storage batteries 118 may be used, including one two, three, four, or more batteries 118. The batteries 118, which can be provided in an enclosure 190, can be coupled or removably coupled to other components in the electrical system. In other embodiments, there may be no batteries 118. Battery 118 has positive terminal 122 and negative terminal 123. The negative terminal 123 is electrically coupled to the cranking motor 116 at terminal 130 via an electrical path 126 that includes a suitable cable. The positive terminal 122 is electrically coupled to a B terminal 134 of the cranking motor 116 via an electrical path 128 that includes a suitable cable. In some embodiments, the electrical path 128 may also include a master disconnect switch (not shown) which is operable between a closed position which closes the electrical path 128 and an open position which opens the electrical path 128. Current from the batteries 118 is switched to the cranking motor 116 via a switch such as a conventional solenoid switch 138. All of the elements 112 through 138 described above may be arranged in various embodiments without falling beyond scope of the present disclosure.

The solenoid switch 138 is activated for example when an ignition switch 140, located in the front of the vehicle, is moved to a start position. The ignition switch 140 can be a double pole, single throw (DPST) start switch comprised of parts such as that supplied by McMaster Carr, including an actuator as part number 7544K33, a contact block kit as part number 7557K44. The ignition switch 140 is comprised of a first switch having switched terminals 141, 142, and a second switch having switched terminals 143, 144. In operation, the engine is operably moved between a running condition and an off condition. A conventional ignition switch includes four positions: accessory, off, on/run, and start. The terminals 143, 144 are used to interface with the vehicle's existing starting circuit (not shown) for ignition if the ignition switch 140 cannot provide the needed set of separate and independent contacts. Of course, in other embodiments, other switches having other positions can be used. In addition, in some embodiments, a switch can be positioned between at least an off and run position, and a separate push-button, crank switch is actuated to crank the motor. In such an embodiment, one or both of the off/run switch and the separate push-button switch are defined as an ignition switch, with the combined ignition switches being in the "start" position when the on/off switch is in the "on" position and the crank switch is in the engaged position. As in the embodiments of FIGS. 1-3, the electrical system of FIGS. 4-6 may also have a rear ignition switch (not shown) which is identical to the ignition switch 140 except that it is located in the rear rather than the front of the vehicle. The rear ignition switch may be a DPST start switch comprised of a first switch having two switched terminals and a second switch having two switched terminals.

In addition to the conventional electrical system described above, the vehicle also includes a supplemental electrical system including a capacitor 160 and a control circuit. The supplemental electrical system, which can be housed in an enclosure 192, can be coupled or removably coupled to the conventional electrical system. The capacitor 160 may be similar to capacitor 60. Moreover, the capacitor 160 could be of any other type suitable for the present disclosure. Though not shown in the Figures, the electrical system of the vehicle includes a conventional generator or alternator driven by the engine when running to charge both the batteries 118 and capacitor 160. In embodiments lacking the batteries 118, the generator or alternator, or another feature of the electrical system, charges the capacitor 160, but does not charge any batteries 118.

The capacitor 160 includes a positive terminal 162 and a negative terminal 164. The negative terminal 164 is electrically coupled to a ground via electrical path 166. The positive terminal 162 is electrically coupled to the positive terminal 122 of battery 118 via the electrical path 167 that includes a suitable cable and a relay 170 that is included in the control circuit. In embodiments lacking the batteries 118, the terminals 122, 123 and the electrical path 126 are also absent, and thus the electrical path 128 and electrical path 167 may form a single direct electrical path.

The relay 170 includes first and second control terminals 172, 174 and first and second switched terminals 176, 178. The first control terminal 172 is electrically coupled to the switched terminal 141 of the ignition switch 140 via an electrical path that includes a suitable cable and a diode 194. The second control terminal 174 is electrically coupled to a ground. The switched terminals 176, 178 are included in the electrical path 167 such that the relay 170 interrupts the electrical path 167 when the relay is in an open-circuit condition. The relay 170 completes the electrical path 167 when the relay is in a closed-circuit condition. The relay 170 may take many forms, and may be a contactor relay, for example of the type discussed earlier. The switched terminal 142 of the ignition switch 140 is electrically coupled to the positive terminal 162 of the capacitor 160 via an electrical path that includes a suitable cable and a five amp fuse 169.

The control circuit includes a timer relay 180 having start, power, and load switched terminals 182, 184, 186 and a system ground 188. The timer relay 180, which can be of the type discussed earlier, has a timer 181. The start switched terminal 182 (or control terminal) of the timer relay 180 is electrically coupled to the switched terminal 141 of the ignition switch 140 via an electrical path. The power switched terminal 184 of the timer relay 180 is electrically coupled to the first switched terminal 176 of the relay 170 via an electrical path that includes a five amp fuse 168. The load switched terminal 186 of the timer relay 180 is electrically coupled to the first control terminal 172 of the relay 170 via an electrical path that includes a suitable cable and a diode 196. The timer relay 180 is operable to switch between an open-circuit condition, startup condition, and timer condition, as will be described below in more detail.

The operation of the electrical systems is shown sequentially in FIGS. 4-6. FIG. 4 shows the ignition switch 140 in its off positions, and the relay 170 and the timer relay 180 each in their respective open-circuit conditions. The batteries 118 may contain energy or may be in a charged or discharged state.

FIG. 5 shows the ignition switch 140 switched into the start position which causes the capacitor 160 to apply to a voltage between the control terminals 172, 174, thus closing the relay 170 and completing the electrical path 167. Thus the capacitor 160 and the batteries 118 are each connected along electrical paths to the cranking motor 116. The batteries 118, if they are installed and have any charge, and the capacitor 160 power the cranking motor 116 during ignition. However if the batteries 118 are discharged or absent, the capacitor 160 is operable on its own to power the cranking motor 116 during ignition. Thus, even in embodiments lacking batteries altogether, the capacitor 160 can still power the cranking motor 116. The capacitor 160 also applies a voltage between the start switched terminal 182 and the power and/or load switched terminals 184, 186, thus activating the timer relay 180 from the open-circuit condition to the startup condition. In other embodiments (not shown), a secondary capacitor, secondary battery, or other power source, rather than the capacitor 160, can provide the voltage between the start switched terminal 182 and the power and/or load switched terminals 184, 186. The rear ignition switch (not shown) can be used instead of ignition switch 140 to initiate the same processes described above.

FIG. 6 shows the ignition switch 140 switched into the on/run position, which opens the electrical paths between switched terminals 141 and 142 and between switched terminals 143 and 144. Thus the capacitor 160 no longer applies a voltage between the start switched terminal 182 and the power and/or load switched terminals 184, 186, causing the timer relay 180 to exit the startup condition and enter the timer condition. In the timer condition, the timer 181 tracks temporal information, and the control voltage applied between the control terminals 172 and 174 varies in response to the tracked temporal information. More specifically, a timer 181 begins counting down a predetermined period of time. In the timer condition, a closed electrical path is formed between the power and load switched terminals 184, 186, causing the capacitor 160 to continue to apply a voltage between the control terminals 172 and 174 thus keeping the relay 170 closed and the electrical path 167 closed. Thus a part of the vehicle electrical system, for example the generator or alternator, charges the capacitor 160 during the predetermined period of time in the timer condition. The predetermined period of time is selected to have a value sufficient for the capacitor 160 to be fully charged. For example, the predetermined period of time may have a value between about 30 seconds and about 10 minutes, and preferably takes a value between about 2 and about 3 minutes, for example about 2, 2.5, or 3 minutes. Additionally, the generator or alternator charges the batteries 118, if any.

Once the predetermined period of time on the timer 181 has elapsed, the electrical path between the second and third switched terminals 184, 186 opens, and the timer relay 180 switches from the timer condition to the open-circuit condition. The electrical circuit thus returns to the condition shown in FIG. 4. At this point the capacitor 160 is fully charged, and electrically isolated such that it is prevented from discharging and so that its charge will be available for the next cranking event. The vehicle continues to run, based on power provided from the batteries 118 or from the vehicle electrical system which includes the generator and alternator, until the ignition switch 140 is switched from the on/run position to the off position. The driver of the vehicle is free to use accessory power as desired, but such usage will at most drain the batteries 118, if used, while leaving the capacitor 160 in a full state of charge.

The systems described above in FIGS. 1-6 provide a number of important advantages. The operation of supplemental electrical system is not dependent on any vehicle programming. Rather, the supplemental electrical system can instead be implemented as a self-contained unit, for example in an enclosure 190, that is removably connectable with the vehicle electrical system. By contrast, in prior art embodiments, an oil-pressure sensor has been used to detect when an engine is running, during which time a capacitor is connected to the electrical system. In the embodiment disclosed herein, however, such an oil-pressure sensor is not needed, since the charging time of the capacitor 60, 160 is determined by the timer relay 80, 180.

Additionally, the supplemental electrical systems in FIGS. 1-6 including the capacitor 60, 160 provides adequate current for reliable engine starting, even if the batteries 18, 20, 118 are completely discharged by auxiliary loads when the engine 12 is not running, and even if there are no batteries. Also, the capacitor 60, 160 becomes electrically isolated once it is fully recharged after use in the cranking event. Thus the opportunity for damage to the capacitor 60, 160 is reduced.

The capacitor 60, 160 in FIGS. 1-6 further provides the advantage that it can be implemented with an extremely long-life device that can be charged and discharged many times without reducing its efficiency in supplying adequate cranking current. This system does not interfere with conventional availability of the batteries 18, 20, 118 to power accessories when the engine is off. This reduces the incentive of the vehicle operator to defeat the system.

In the supplemental electrical systems of FIGS. 4-6, the diode 194 is included to prevent the relay 170 from providing power to the start switched terminal 182 of the timer relay 180 while the ignition 140 is in the on/run position, as in FIG. 6. The start switched terminal 182 is intended to receive current only while the ignition 140 is in the start position, as in FIG. 5.

Also in the supplemental electrical systems of FIGS. 4-6, the diode 196 is included because without the diode 196, if the batteries 118 are dead, absent, or have a low charge, and the vehicle demands more power than the batteries 118 (if any) can provide, then when timer relay 180 closes, a ground path is created before the relay 170 closes, causing the vehicle to draw current from capacitor 160 through the timer relay 180, thus tripping the fuse 69. Including the diode 196 ensures that the current will not backfeed and blow the fuse 69.

Additionally, in the embodiments of FIGS. 4-6, the ignition switch 40 is a DPST switch rather than a TPST switch, because the third pole is not used to close the relay 170.

As used herein, the terms "connected" and "coupled with" are intended broadly to encompass one or more of direct, indirect, permanent, or removable coupling. Thus, first and second elements are said to be coupled with one another whether or not a third, unnamed, element is interposed therebetween. For example, two elements may be coupled with one another by means of a switch. The term "battery" is intended broadly to encompass a set of batteries including one or more batteries. The term "set" means one or more. The term "path" is intended broadly to include one or more elements that cooperate to provide electrical interconnection, at least at some times. Thus, a path may include one or more switches or other circuit elements in series with one or more conductors. Various switches and relays can be used to implement the functions described above, and cables and cable terminations can be adapted as appropriate.

As a person skilled in the art will readily appreciate, the above description is meant as an illustration of implementation of the principles of this invention. This description is not intended to limit the scope or application of this invention in that the invention is susceptible to modification, variation and change, without departing from the spirit of this invention, as defined in the following claims.

What is claimed is:

1. An engine cranking system comprising:

an engine operably moveable between a running condition and an off condition;

a cranking motor coupled to the engine;

a capacitor with first and second capacitor terminals;

a first electrical path interconnecting at least one of the cranking motor or at least one battery to one of the first or second capacitor terminals; and a control circuit coupled to the capacitor, the control circuit comprising:

a timer operative to track temporal information, wherein the control circuit is operative to apply a control voltage that varies in response to the tracked temporal information; and a first relay included in the first electrical path, the first relay operative to switch, in response to the control voltage, between a first open-circuit condition, in which the relay interrupts the first electrical path, and a first closed-circuit condition.

2. The engine cranking system of claim 1, wherein the control voltage is applied at least in part from the capacitor.

3. The engine cranking system of claim 1, further comprising at least one battery coupled to the cranking motor, the first electrical path interconnecting the at least one battery to the one of the first or second capacitor terminals.

4. The engine cranking system of claim 1, further comprising a second relay that includes the timer and is operative to switch, in response to the tracked temporal information, between a second open-circuit condition, in which the second relay interrupts a second electrical path, and a second closed-circuit condition.

5. The engine cranking system of claim 1, wherein the temporal information is a predetermined period of time.

6. The engine cranking system of claim 5, wherein the predetermined period of time is between about 2 minutes and about 3 minutes.

7. The engine cranking system of claim 5, wherein the predetermined period of time is selected to ensure the capacitor is fully charged when the predetermined period of time has elapsed.

8. The engine cranking system of claim 5, wherein the timer being operative to track the predetermined period of time comprises the timer being operable to count down the predetermined time during which the control circuit is operative to apply the control voltage.

9. The engine cranking system of claim 8, wherein the control circuit is operative to stop applying the control voltage once the predetermined time has elapsed.

10. The engine cranking system of claim 1, further comprising a switch having a variable switch position, wherein the control circuit is operative to apply the control voltage further in response to the variable switch position.

11. The engine cranking system of claim 1, further comprising first and second switches respectively having first and second variable switch positions, wherein the control circuit is operative to apply the control voltage further in response to at least one of the first and second variable switch positions.

12. The engine cranking system of claim 11, wherein the first and second switches comprise a double pole, single-throw switch.

13. The engine cranking system of claim 12, wherein the double pole, single-throw switch comprises an ignition switch.

14. The engine cranking system of claim 1, further comprising first, second, and third switches respectively having first, second, and third variable switch positions, wherein the control circuit is operative to apply the control voltage further in response to at least one of the first, second, and third variable switch positions, wherein the first, second, and third switches comprise a triple pole, single-throw switch.

15. The engine cranking system of claim 11, further comprising third and fourth switches respectively having third and fourth variable switch positions, wherein the control circuit is operative to apply the control voltage further in response to at least one of the third and fourth variable switch positions.

16. The engine cranking system of claim 1, further comprising at least one diode electrically coupled to the first relay.

17. A method of cranking an engine, the method comprising:

providing an engine cranking system comprising:

an engine operably moveable between a running condition and an off condition;

a cranking motor coupled to the engine;

a capacitor with first and second capacitor terminals;

a first electrical path interconnecting at least one of the cranking motor or at least one battery to one of the first or second capacitor terminals; and a first relay included in the first electrical path;

tracking temporal information;

applying a control voltage that varies in response to the tracking of the temporal information; and switching the first relay, in response to the control voltage being applied thereto, from a first open-circuit condition, in which the relay interrupts the first electrical path, to a first closed-circuit condition, thereby completing the first electrical path.

18. The method of claim 17, wherein the control voltage is applied at least in part from the capacitor.

19. The method of claim 17, the engine cranking system further comprising a second relay that includes the timer, the method further comprising switching the second relay, in response to the temporal information, between a second open-circuit condition, in which the second relay interrupts a second electrical path, and a second closed-circuit condition.

20. The method of claim 17, wherein the temporal information is a predetermined period of time.

21. The method of claim 20, wherein the predetermined period of time is between about 2 minutes and about 3 minutes.

22. The method of claim 20, wherein the predetermined period of time is selected to ensure the capacitor is fully charged when the predetermined period of time has elapsed.

23. The method of claim 20, wherein tracking the predetermined period of time comprises counting down the predetermined time and applying the control voltage during the predetermined period of time.

24. The engine cranking system of claim 23, further comprising preventing application of the control voltage once the predetermined time has elapsed.

25. An engine cranking system comprising:

an engine operably moveable between a running condition and an off condition;

a cranking motor coupled to the engine;

a capacitor with first and second capacitor terminals;

a first electrical path interconnecting at least one of the cranking motor or at least one battery to one of the first or second capacitor terminals; and a control circuit coupled to the capacitor, the control circuit comprising:

a timer relay including a timer that is operative to count down a predetermined period of time, wherein the timer relay is operative to switch, in response to whether the predetermined period of time has elapsed, between a first open-circuit condition, in which the timer relay interrupts a second electrical path, and a first closed-circuit condition, and wherein the control circuit is operative to apply a control voltage, at least in part from the capacitor, that varies in response to the whether the predetermined period of time has elapsed; and a relay included in the first electrical path, the relay operative to switch, in response to the control voltage, between a second open-circuit condition, in which the relay interrupts the first electrical path, and a second closed-circuit condition.

* * * * *